US005825274A

United States Patent [19]

Totsuka

[11] Patent Number: 5,825,274

[45] Date of Patent: Oct. 20, 1998

[54] FUSIBLE LINK

[75] Inventor: Mitsuhiko Totsuka, Shizuoka, Japan

[73] Assignee: Yazaki Corporation, Tokyo, Japan

[21] Appl. No.: 731,557

[22] Filed: Oct. 16, 1996

[30] Foreign Application Priority Data

Oct. 17, 1995 [JP] Japan ..... 7-268635
Jul. 11, 1996 [JP] Japan ..... 8-182145

[51] Int. Cl.[6] ..... H01H 85/04; H01H 85/143; H01H 85/36

[52] U.S. Cl. ..... 337/190; 337/159; 337/227; 337/228; 337/238

[58] Field of Search ..... 337/159, 238, 337/239, 261, 295, 240, 168, 260, 219, 197, 198, 142, 186, 190, 195, 401, 405, 407, 414, 415

[56] References Cited

U.S. PATENT DOCUMENTS 1,867,784 7/1932 Trumbull ..... 337/261
4,871,990 10/1989 Ikeda et al. ..... 337/238
5,416,461 5/1995 Totsuka et al. ..... 337/261
5,670,929 9/1997 Totsuka ..... 337/201

*Primary Examiner*—Leo P. Picard
*Assistant Examiner*—Anatoly Vortman
*Attorney, Agent, or Firm*—Morgan, Lewis & Bockius LLP

[57] ABSTRACT

A fusible link includes a housing which is made of insulating resin, the housing has an opening through which a fuse element is inserted into the housing, a fuse element having a pair of connecting terminal sections and a fusible body connected between the connecting terminal sections, and a lid of insulating resin which covers the opening of the housing while engaging with the housing. In the fusible link, the lid has resilient protruded pieces which are extended downwardly from the inner surface of the lid, and pressed against the fuse element so that the fused ends of the fuse element are away from each other when the fusible body is fused, thereby to positively prevent the occurrence of secondary short-circuiting of the fused ends.

10 Claims, 6 Drawing Sheets

FUSIBLE LINK

BACKGROUND OF THE INVENTION

1. Field of the Invention

This invention relates to a fusible link, and more particularly to a fusible link of cartridge type that a fuse element including a pair of connecting terminal sections and a fusible body which are provided as one unit by stamping a metal plate is accommodated in a housing made of insulating resin.

2. Background

In FIGS. 7 and 8, reference numeral 1 designates a conventional fusible link of cartridge type. The conventional fusible link 1, being disclosed by Unexamined Japanese Utility Model Publication No. Sho. 64-33146, includes: a housing 3 made of insulating resin, the housing 3 having an opening 2 at one end through which a fuse element 6 (described later) is inserted into the housing 3; the fuse element 6 which includes a pair of connecting terminals 4 and 4, and a fusible body connected between those connecting terminals 4 which are provided as one unit by stamping a metal plate; and a lid 7 which is also made of insulating resin, the lid 7 being adapted to cover the opening 2 of the housing and having engaging members (not shown) which are engaged with the housing 3.

As shown in FIG. 8, each of the connecting terminals 4 of the fuse element 6 includes an electric contact section 8 which is engaged with a tongue-shaped male connecting terminal.

As shown in FIG. 7, the inside of the housing is divided into two parts; that is, the housing 3 has a pair of terminal accommodating chambers 10 and 10 in which the pair of connecting terminals 4 and 4 of the fuse element 6 are held, respectively. The housing 3 has a bottom wall at the other end, and male terminal inserting holes 11 and 11 formed in the bottom wall in correspondence to the terminal accommodating chambers 10 and 10. The male terminal inserting holes 11 are to allow male connecting terminals (not shown) to engage with the electrical contact sections 8.

The fuse element 6 inserted into the housing 3 through the opening 2 is fixedly held in the housing 3 as follows: As shown in FIG. 7, resilient locking protrusions 13 and 13 (hereinafter referred to as "lances 13", when applicable) which are formed by cutting and raising the rear plates of the electrical contact sections 8 are engaged with steps 14 formed in the inner surfaces of the walls of the terminal accommodating chambers 10, thereby to prevent the movement of the fuse element 6 towards the opening 2; while the front ends of the electrical contact sections 8 abut against housing front walls 15 (the bottom wall of the housing 3) which define the male terminal inserting holes 11, thereby to prevent the movement of the fuse element 6 in the opposite direction (towards the bottom of the housing 3).

The lid 7 is adapted to prevent the entrance of dust etc. into the housing to protect the fuse element 6, and to prevent splashing fused metal particles to outside when the fusible body is fused.

Incidentally, when the fusible body 5 of the fuse element is fused by over-current, the connecting terminals 4 which have been separated from each other by fusing are tilted towards each other, then the ends of the fusible bodies remaining on the connecting terminals 4 and 4 may be brought into contact with each other; that is, an accident, so-called "secondary short-circuiting", may occur.

In order to eliminate the occurrence of "secondary short-circuiting", the connecting terminals 4 and 4 include resilient protrusions 17 which abut against the insulating wall 9 to urge the fused end portions of the fusible bodies 5 to move away from each other.

FIG. 9 shows the fact that, when the fusible body 5 is fused, the ends 18 and 18 of the fusible bodies remaining on the connecting terminals are moved away from each other by the resilient protrusions 17.

However, the fuse element with the resilient protrusions for the prevention of the occurrence of secondary short-circuiting is intricate in structure as much as it has the resilient protrusions, and accordingly its unfolded configuration is complicated. Hence, its blanking operation is rather difficult. Moreover, blanking a belt-shaped metal plate to obtain a plurality of unfolded fuse elements, is obliged to increase the blanking pitch, which adversely affects the economical use of the material as much, lowering the yield of material.

In addition, the employment of the resilient protrusions makes the fuse-element forming step intricate, so that the latter is relatively high in manufacturing cost.

The fusible link of cartridge type is advantageous in that, when the fuse element is fused, it can be readily replaced with a new one, and that it is suitable for reduction of the contact resistance of the connected point, whereby it is used in an electrical circuit requiring relatively large current. On the other hand, recently, in order to improve electrical characteristics such as for instance contact resistance, a fusible link has been developed in which its electrical contact section integral with a fuse element is replaced with an electrical contact section which is in the form of a box. However, when unfolded, the box-shaped electrical contact section is more intricate in configuration than the conventional cylindrical electrical contact section. Hence, when compared with the fuse element having the conventional cylindrical electrical contact section, the fuse element having the box-shaped electrical contact section is low in plate blanking efficiency, low in the yield of material, and high in manufacturing cost.

SUMMARY OF THE INVENTION

In view of the foregoing, an object of the invention is to provide a fusible link in which, when the fusible body of the fuse element is fused, the fused end portions thereof are quickly moved away from each other, thereby to positively prevent the occurrence of secondary short-circuiting.

Another object of the invention is to provide a fusible link in which the fuse element is simple in structure, and is improved in the yield of material, and which is reduced in manufacturing cost.

The foregoing objects and other objects of the invention have been achieved by the provision of the following device.

The first device is a fusible link including a housing which is made of an insulating resin, and has an opening at one end through which a fuse element is inserted into the housing; a fuse element including a pair of connecting terminal sections and a fusible body through which the connecting terminal sections are electrically connected to each other, the connecting terminal sections, and the fusible body being provided as one unit by stamping a metal plate; and a lid which is made of an insulating resin, the lid being adapted to cover the opening of the housing, and having engaging members which are engaged with the housing, in which, according to one aspect of the invention, the lid has resilient protruded pieces which are extended downwardly from the inner surface of the lid, and abutted against the fuse element, when the fusible body is fused, the fused ends of the fuse element away from each other.

In the fusible link, the inner surfaces of walls of the housing which define a space for accommodating the fuse element may include tapered surfaces which are so inclined as to facilitate, when the fusible body of the fuse element is fused, the movement of the fused ends of the fuse element from each other by the resilient protruded piece.

In addition, in the fusible link, the tapered surfaces may be inclined surfaces which are adapted to guide the insertion of the fuse element into the housing.

The second device is a fusible link including a housing which is made of an insulating resin, and has top and bottom openings through which a fuse element is inserted into the housing; a fuse element including a pair of connecting terminal sections, and a fusible body through which the connecting terminal sections are electrically connected to each other, the connecting terminal sections, and the fusible body being provided as one unit by stamping a metal plate, the fuse element being inserted into the housing through the bottom opening; a lid which is made of an insulating resin, the lid being adapted to cover the top opening of the housing, and having engaging members which are engaged with the housing and a spacer which supports the fuse element and is locked to the bottom opening of the housing in such a manner as to close the bottom opening of the housing in which, according to another aspect of the invention, the spacer has resilient protruded pieces which are extended upwardly therefrom, the resilient protruded pieces being abutted against the fuse element, when the fusible body is fused, the fused ends of the fuse element away from each other.

After the fusible body of the fuse element is fused, the resilient protruded pieces, which are extended from the inner surface of the lid or from the upper surface of the spacer and maintained pressed against the fuse element, accelerate the movement of the fused end of the fuse element from each other, thereby to prevent the occurrence of secondary short-circuiting.

Hence, the fusible link of the invention is free from the drawback accompanying the conventional one that, in order to prevent the occurrence of secondary short-circuiting, the fuse element itself has special resilient protruded pieces. That is, in the fusible link of the invention, the structure for preventing the occurrence of short-circuiting is simplified.

With the fusible link in which the inner surface of the walls of the housing, which provides the space for accommodating the fuse element, is formed into the tapered surfaces which, when the fusible body of the fuse element is fused, accelerates the movement of the fused ends of the fuse element from each other the movement of the fused ends of the fuse element from each other is achieved more positively; that is, the occurrence of short-circuiting is positively prevented.

DETAILED DESCRIPTION OF THE PREFERRED EMBODIMENTS

Figure 1:
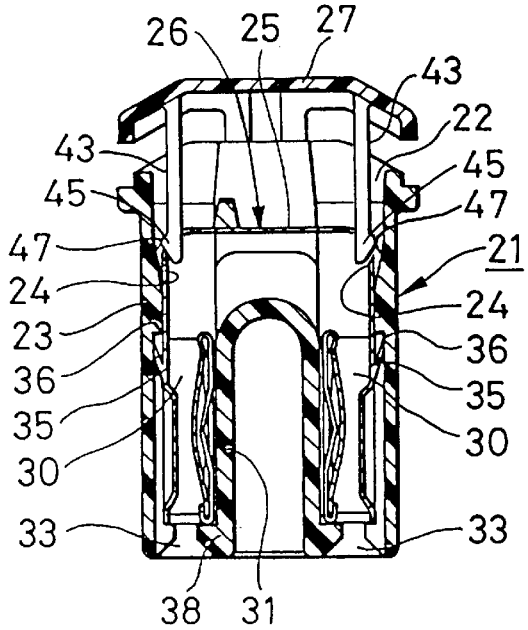
FIG. 1 is a vertical sectional view showing an example of a fusible link of a first embodiment of the invention.

Preferred embodiments of the invention will be described with reference to the accompanying drawings.

First Embodiment

A fusible link of a first embodiment of the invention will be described with reference to FIGS. 1 through 4.

In FIGS. 1 through 4, reference numeral 21 designates the fusible link. The fusible link 21 includes a housing 23, a fuse element 26 and a lid 27. The housing 23 is formed by injection-molding an insulating resin material, and has an opening 22 at one end through which the fuse element 26 is inserted into the housing 23. The fuse element 26 includes a pair of connecting terminal sections 24 and 24, and a fusible body 25 through which the base ends of the connecting terminal sections 24 are electrically connected to each other. The connecting terminal sections 24 and the fusible body 25 are provided as one unit by stamping a metal plate. The lid 27 is also formed by injection-molding an insulating resin material. The lid 27 is adapted to cover the opening 22 of the housing, and has engaging members 28 which are engaged with the housing 23.

Figure 3:
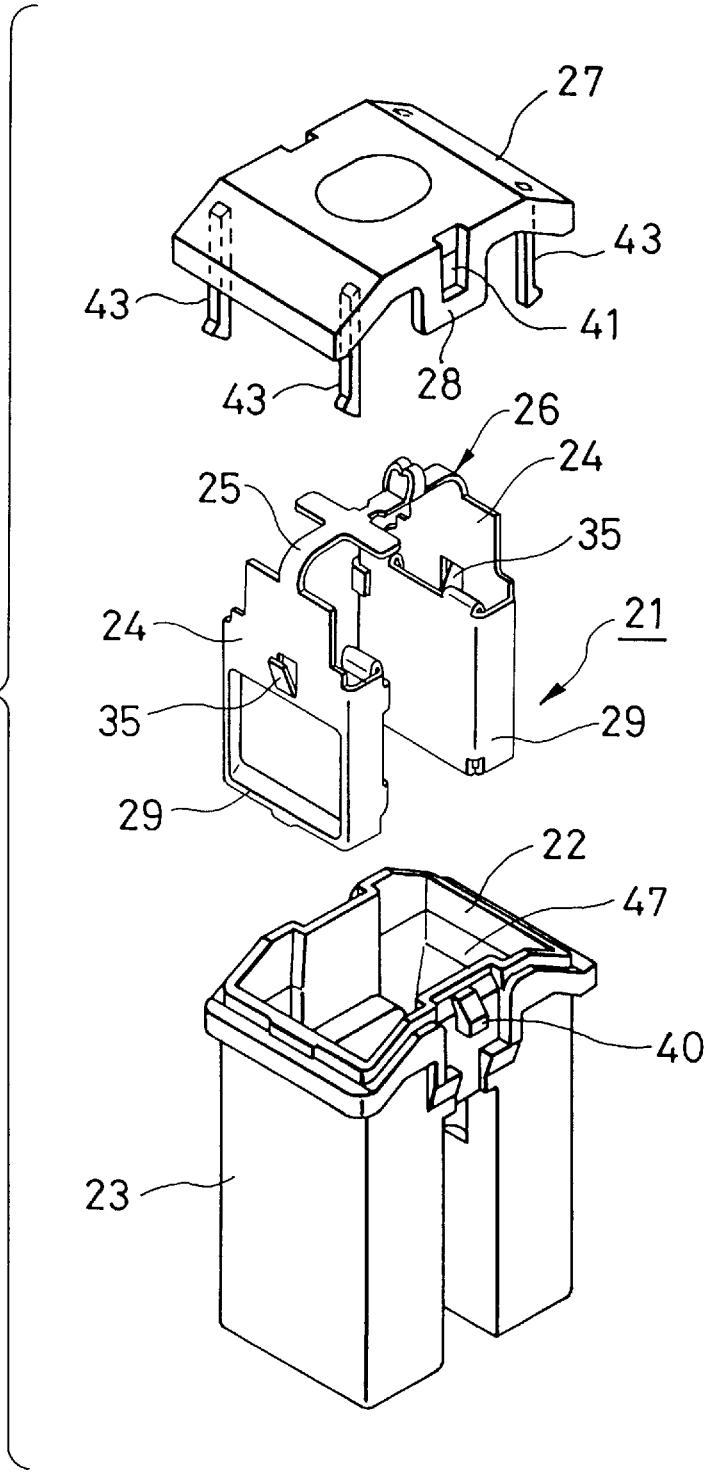
FIG. 3 is an exploded perspective view of the fusible link shown in FIG. 1.
Figure 4:
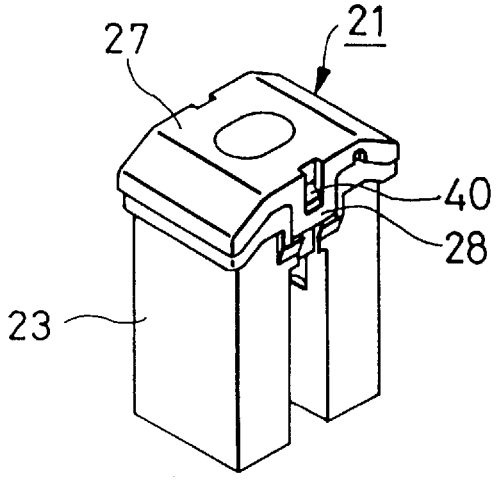
FIG. 4 is a perspective view of the fusible link which has been assembled.

The connecting terminal sections 24 of the fuse element 26, as shown in FIG. 3, include box-shaped electrical contact sections 29 which are engaged with tongue-shaped male connecting terminals (not shown) at the front ends, respectively.

The inside of the housing 23 is divided into two chambers, namely, a pair of terminal accommodating chambers 30 and 30 by an insulating wall 31, which accommodate the connecting terminal sections 24 and 24 of the fuse element 26, respectively. As is apparent from those figures, the housing 23 has two bottom walls on the side which is opposite to the side where the opening 22 is provided. The two bottom walls have male terminal inserting holes 33 and 33 which are communicated with the terminal accommodating chambers 30 and 30, respectively. The male terminal inserting holes 33 are to engage the male connecting terminals (not shown) with the electrical contact sections 29 and 29 accommodated in the terminal accommodating chambers 30 and 30, respectively.

Figure 2:
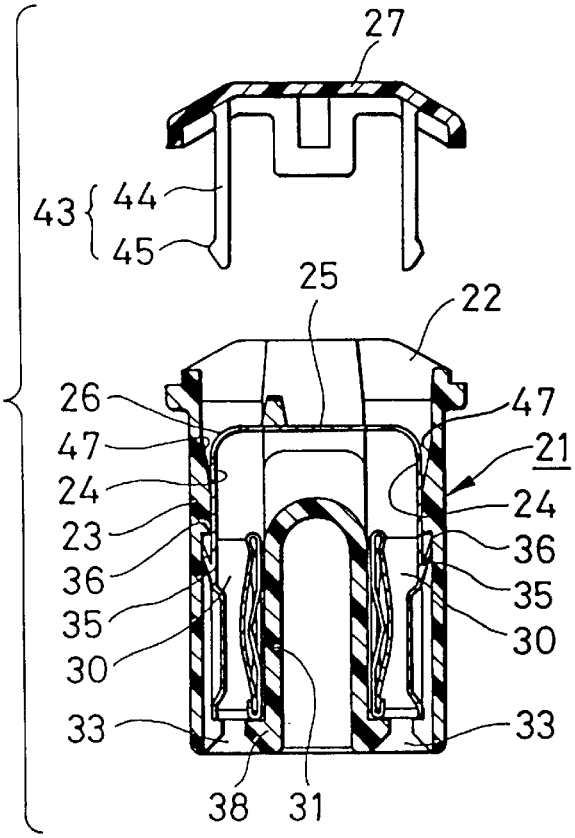
FIG. 2 is a vertical sectional view of the fusible link shown in FIG. 1 with its lid removed therefrom.

The fuse element 26 inserted into the housing 23 through the opening 22 is fixedly held in the housing 23 as follows: As shown in FIGS. 1 and 2, resilient locking protrusions 35 and 35 (hereinafter referred to as "lances 35", when applicable) which are formed by cutting and raising the rear plates of the electrical contact sections 29 are engaged with steps 36 and 36 formed in the inner surfaces of the walls of the terminal accommodating chambers 30 and 30, thereby to prevent the movement of the fuse element 26 towards the opening 22; while the front ends of the electrical contact sections 29 abut against housing front walls 38 (the bottom walls of the housing 23) which define the male terminal inserting holes 33, thereby to prevent the movement of the fuse element 6 in the opposite direction (towards the bottom of the housing 23).

The lid 27 is adapted to prevent the entrance of dust or the like into the housing to protect the fuse element 26, and to prevent splashing the fused metal particles to outside when the fuse element is fused.

The engaging members 28 for fixedly mounting the lid 27 on the housing 23 are resilient pieces which, as shown in FIG. 3, are extended from both opposite edges of the lid 27, and have locking holes 41t which are engaged with locking protrusions 40 which are protruded from the outer surfaces of the opposite walls of the housing 23 near the opening 22.

In the embodiment, four resilient protrusions 43 are extended downwardly from the inner surface of the lid 27, which abut against the rear surfaces of the connecting terminal sections 24 so as to quickly move the fused ends of the fuse element 26 away from each other when the fusible body 25 is fused.

The resilient protruded pieces 43 include bar-shaped portions 44 which are extended downwardly from the inner surface of the lid 27 and are elastically displaceable from each other (towards the respective adjacent connecting terminals 24 and 24), and protrusions 45 forming the ends of the bar-shaped portions 44. The protrusion 45 are abutted against the rear surfaces of the connecting terminal sections 24. That is, the resilient protruded pieces 43 are parts of the lid 27.

The inner surfaces of the side walls of the housing 23 are formed into tapered surfaces 47 which are sloped as guide surfaces to facilitate the insertion of the fuse element 26. The protrusions 45 of the resilient protruded pieces 43 are so designed that they are abutted against the rear surfaces of the connecting terminal sections 24 while being located within the range of the tapered surfaces 47. Hence, between the tapered surfaces 47 and the rear surfaces of the connecting terminal sections 24, relief spaces are formed which, when the fusible body 25 is fused so that the pair of connecting terminal sections 24 are separated from each other, allow the latter 24 to fall on the tapered surfaces 47.

In other words, the tapered surfaces 47 function as sloped surfaces which, when the fusible body 25 of the fuse element 26 is fused, the fused ends are more positively spaced away from each other by the resilient protruded pieces 43.

In the fusible link 21 thus designed, the resilient protruded pieces 43 extended from the inner surface of the lid 27 are maintained pressed against the connecting terminal sections 24 of the fusible element 26 at all times. Hence, when the fusible body 25 of the fuse element 26 is fused, the distance between the fused ends of the fuse element is quickly increased by the resilient protruded pieces 43, thereby to positively prevent the occurrence of secondary short-circuiting.

Hence, the first embodiment is free from the drawback accompanying the conventional art that, in order to prevent the occurrence of secondary short-circuiting, it is unnecessary to provide special resilient protruded pieces (43) on the fuse element (26). This feature simplifies the structure of the fuse element 26, prevents the occurrent of secondary short-circuiting, improves the yield of material for the fuse element, and reduces the manufacturing cost of the fusible link.

As was described above, the inner surfaces of the side walls of the housing which form a space for accommodating the fuse element 26 are formed into the tapered surfaces 47 which, when the fusible body 25 of the fuse element 26 is fused, allows the fused ends of the fuse element 26 to further move away from each other. The fused ends of the fuse element are more positively moved away from each other, which prevents the occurrence of secondary short-circuiting with high reliability.

Second Embodiment

A fusible link of a second embodiment of the invention will be described with reference to FIGS. 5 and 6.

Figure 5:
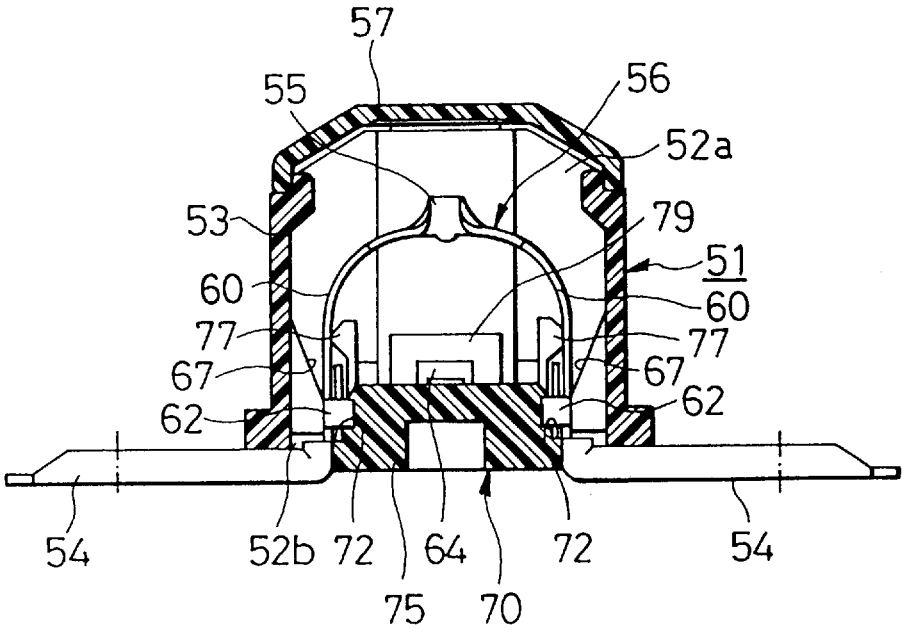
FIG. 5 is a vertical sectional view showing another example of the fusible link, which is a second embodiment of the invention.
Figure 6:
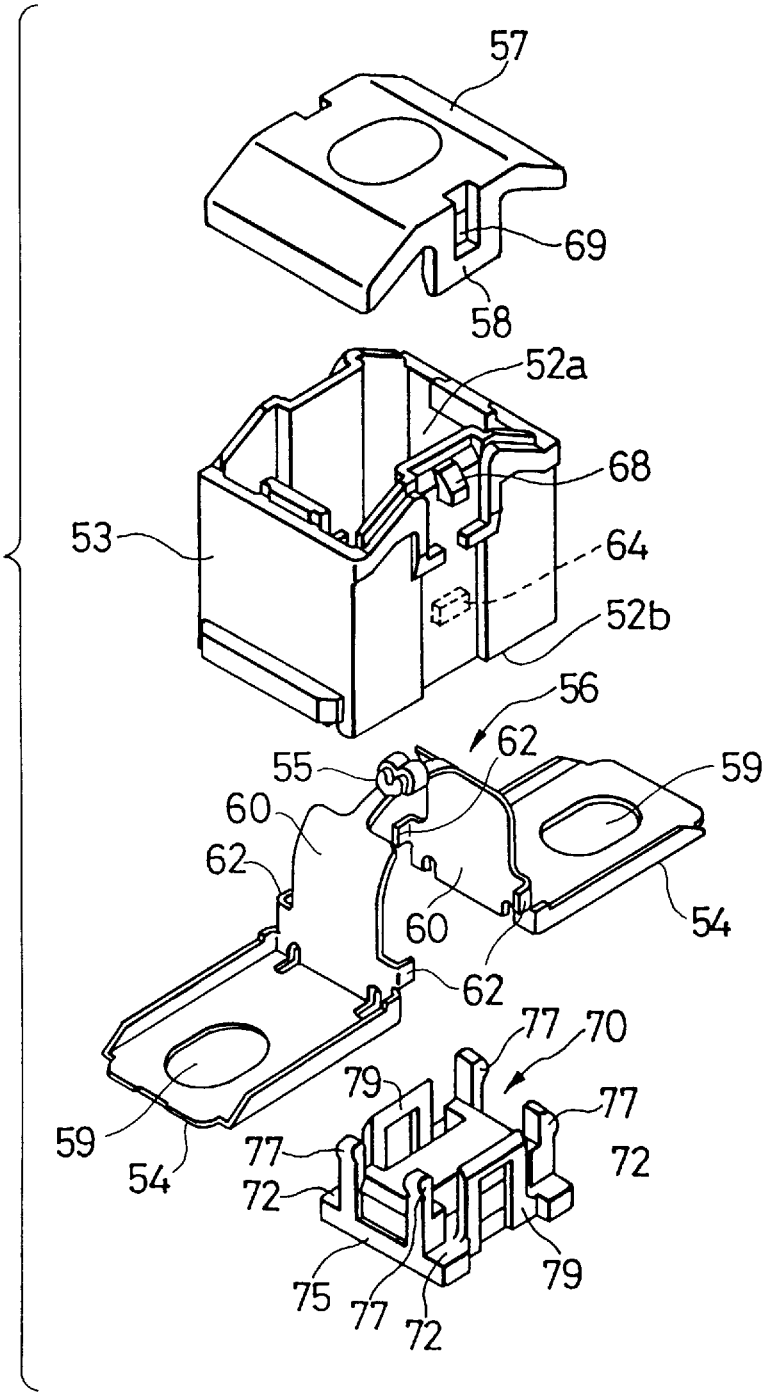
FIG. 6 is an exploded perspective view of the fusible link of the second embodiment shown in FIG. 4.
Figure 7:
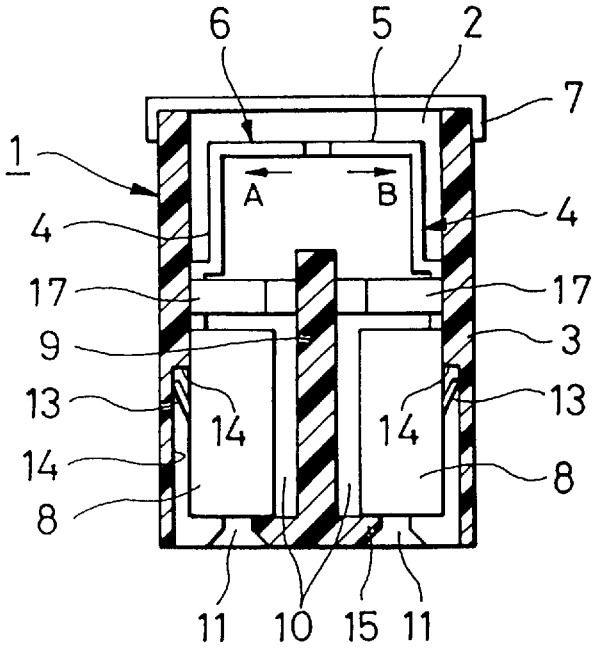
FIG. 7 PRIOR ART
FIG. 7 is a vertical sectional view showing a conventional fusible link which has been assembled.
Figure 8:
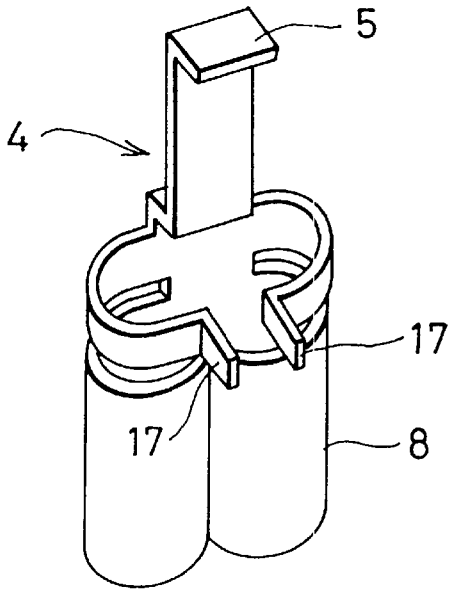
FIG. 8 PRIOR ART
FIG. 8 is a perspective view for a description of the structure of a connecting terminal section of the conventional fusible link shown in FIG. 7.
Figure 9:
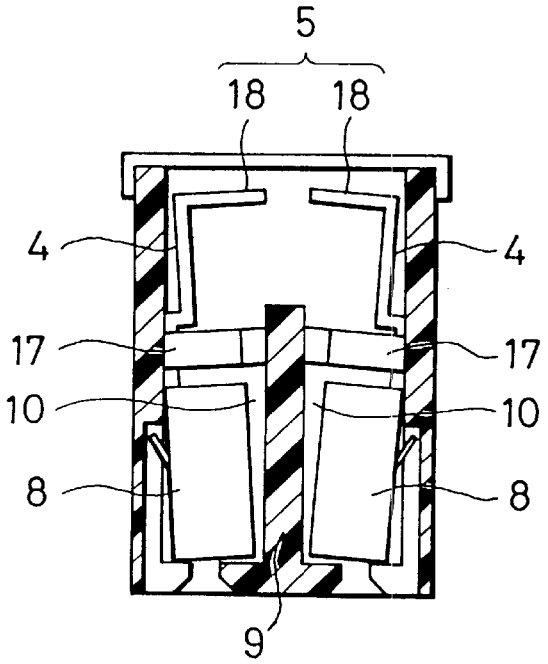
FIG. 9 PRIOR ART
FIG. 9 is a vertical sectional view showing a state of the conventional fusible link in which the fusible body has been fused.

In FIGS. 5 and 6, reference numeral 51 designates the fusible link. The fusible link 51 is of the type that a fuse element is electrically connected to bus bars or the like in an electrical circuit with screws. Generally, an electrical circuit to which the second embodiment is applied is larger in current capacity (80 A to 140 A in rated current) than an electrical circuit to which the above-described first embodiment (20 A to 80 A in rated current).

The fusible link 5 includes a housing 53, a fuse element 56, a lid 57 and a spacer 70. The housing 53 is made of insulating resin, and formed by injection molding in such a manner that it is substantially in the form of a rectangular box opened at both ends. The lid 57 is also made of insulating resin by injection molding. The lid 57 is adapted to close the top opening 52*a* (the upper opening in FIG. 5 or 6) of the housing 53, and has engaging members 58 which are engaged with the housing 53. The spacer 70 is also made of insulating resin by injection molding. The spacer 70 supports the fuse element 56, and it is locked to the bottom opening 52*b* (the lower opening in FIG. 5 or 6) of the housing 53 in such a manner as to close the bottom opening thereby to prevent the fuse element 56 from coming off the housing.

The fuse element 56 has a pair of connecting terminal sections 54 and 54 which are in one and the same plane, The connecting terminal sections 54 are connected to the electrical connecting sections of the battery (not shown). The connecting terminal sections 54 and 54 have mounting holes 59 and 59, respectively. Bolts (not shown) are inserted into the mounting holes 59 to connect the connecting terminal sections 54 to the battery. A pair of plate-shaped legs 60 are extended from the inner edges of the connecting terminals sections 54 which are confronted with each other in such a manner that they are extended vertical with respect to the latter 54. The upper end portions of the vertical plate-shaped legs 60 are coupled through a fusible body 55 to each other. Hence, the fuse element is bisymmetrical with respect to the fusible body 55.

The vertical plate-shaped legs 60 have each two locking pawls 62 near its base end in such a manner that the two locking pawls 62 of one of the vertical legs 60, and the two locking pawls 62 of the other vertical plate-shaped legs 60 are extended towards each other. The locking pawls 62 may be formed, for instance, as follows: First, the vertical plate-shaped legs 60 are formed each of which has two protrusions near its base end. Thereafter, the two protrusions of one of the vertical plate-shaped legs 60, and the two protrusions of the other vertical plate-shaped legs 60 are bent towards each other.

The fuse element 56 is inserted into the housing 53 through the bottom opening 52*b*, and held with the spacer 70 locked to the housing 53 so that it may not come off the latter 53.

The spacer 70 includes a spacer body 75 with seats 72 which abut against the lower edges of the locking pawls 62, respectively, to support the fuse element 56. The spacer body 75 has a pair of locking frames 79 which are engaged with the inner surfaces of the walls of the housing 53. The spacer 70 is engaged with the housing 53 as follows: With the spacer 70 abutted against the fuse element 56 to be inserted into the housing, the locking frames 79 are engaged with engaging protrusions 64 which are protruded from the inner surfaces of the opposite walls of the housing, so that the spacer 70 is fixedly engaged with the housing 53, and holds the fuse element 56 (preventing the latter 56 from coming off).

Four resilient protruded pieces 77 are extended vertically from four corners of the spacer body 75 except the seats 72 of the spacer 70. Those resilient protruded pieces 77 are pressed against the inner surfaces of the plate-shaped legs 60 of the fuse element 56 which are confronted with each other, thereby to move, when the fuse element 56 is fused, the fused ends of the fuse element 56 away from each other.

On the other hand, the inner surfaces of the walls of the housing 53 are formed into tapered surfaces 67 which are so inclined as to accelerate the movement of the fused ends of the fuse element 56. That is, between the tapered surfaces 67 and the plate-shaped legs 60, spaces are provided which allow the plate-shaped legs 60 to fall towards the tapered surfaces 67 when the fusible body is fused, that is, when the connecting terminal sections 54 and 54 are separated from each other.

Similarly as in the above-described first embodiment, the lid 57 functions to prevent the entrance of dust or the like into the housing 53 thereby to protect the fuse element 56, and to prevent splashing the fused particles to outside when the fuse element 56 is fused.

The engaging member 58 adapted to engage the lid 57 with the housing 53, as shown in FIG. 6, are resilient pieces having engaging holes 69. The engaging holes 69 are adapted to engage with locking protrusions 68 which are formed on the outer surfaces of the walls of the housing 53 near the upper end. That is, lid 57 has the two engaging members 58 respectively on both sides thereof.

In the second embodiment, when the fusible body 55 of the fuse element 56 is fused, the distance between the fused ends of the fuse element 56 is quickly increased by the resilient protruded pieces 77 of the spacer 7 which are maintained pressed against the plate-shaped legs 60 of the fuse element 56, which positively prevents the occurrence of secondary short-circuiting.

Hence, the second embodiment is free from the drawback accompanying the conventional art that, in order to prevent the occurrence of secondary short-circuiting, the fuse element itself has special resilient protruded pieces. This feature simplifies the structure of the fuse element 56, improves the yield of material of the fuse element 56, and decreases the manufacturing cost of the fuse element 56.

Furthermore, the inner surfaces of the walls of the housing, which forms the space for accommodating the fuse element, are formed into the tapered surfaces which, when the fusible body 55 of the fuse element 56 is fused, accelerates the movement of the fused ends of the fuse element by the resilient protruded pieces 77 of the spacer 70. Hence, the fused ends of the fuse element are positively moved away from each other, which positively prevents the occurrence of secondary short-circuiting.

As was described above, after the fusible body of the fuse element is fused, the resilient protruded pieces, which are extended from the inner surface of the lid or from the upper surface of the spacer and maintained pressed against the fuse element, accelerate the movement of the fused end of the fuse element from each other, thereby to prevent the occurrence of secondary short-circuiting.

Hence, the fusible link of the invention is free from the drawback accompanying the conventional one that, in order to prevent the occurrence of secondary short-circuiting, the fuse element itself has special resilient protruded pieces. That is, in the fusible link of the invention, the structure for preventing the occurrence of short-circuiting is simplified.

With the fusible link in which the inner surface of the walls of the housing, which provides the space for accommodating the fuse element, is formed into the tapered surfaces which, when the fusible body of the fuse element is fused, accelerates the movement of the fused ends of the fuse element from each other; that is, the occurrent of short-circuiting is positively prevented.

What is claimed is:

1. A fusible link, comprising:

a housing having an opening at a first end thereof;

a fuse element including a pair of connecting terminal sections and a fusible body through which said connecting terminal sections are electrically connected to each other, said fuse element inserted into said housing through said opening;

a lid adapted to cover said opening of said housing, said lid having a engaging member which is engaged with a retaining member of said housing; and a plurality of resilient protruded pieces formed on said lid, said resilient protruded pieces being extended downwardly from an inner surface of said lid to outwardly urge inner surfaces of said connecting terminal sections, wherein when said fusible body is fused, said resilient protruded pieces outwardly press said connecting terminal sections so that the fused ends of said fuse element are away from each other.

2. The fusible link of claim 1, further comprising inclined surfaces formed on inner surfaces of walls of said housing to define a space for accommodating said fuse element, in order to facilitate the movement of the fused ends of said fuse element being away from each other by said resilient protruded piece when said fusible body of said fuse element is fused.

3. The fusible link of claim 2, wherein said inclined surfaces are adapted to guide the insertion of said fuse element into said housing.

4. The fusible link of claim 1, wherein said resilient protruded pieces have projections for abutting against said inner surfaces of said connecting terminal sections.

5. The fusible link of claim 1, wherein said resilient protruded pieces are four pieces.

6. A fusible link, comprising:

a housing having a top opening and bottom opening;

a fuse element including a pair of connecting terminal sections and a fusible body through which said connecting terminal sections are electrically connected to each other, said fuse element inserted into said housing through said bottom opening;

a lid adapted to cover said opening of said housing, said lid having a engaging member which is engaged with a retaining member of said housing;

a spacer supporting said fuse element, said spacer locked to said bottom opening of said housing to close said bottom opening of said housing; and a plurality of resilient protruded pieces formed on said spacer, said resilient protruded pieces being extended upwardly from an inner surface of said spacer to outwardly urge inner surfaces of said connecting terminal sections, wherein when said fusible body is fused, said resilient protruded pieces outwardly press said connecting terminal sections so that the fused ends of said fuse element are away from each other.

7. The fusible link of claim 6, further comprising inclined surfaces formed on inner surfaces of walls of said housing to define a space for accommodating said fuse element, in order to facilitate the movement of the fused ends of said fuse element away from each other by said resilient protruded piece when said fusible body of said fuse element is fused.

8. The fusible link of claim 7, wherein said inclined surfaces are adapted to guide the insertion of said fuse element into said housing.

9. The fusible link of claim 6, wherein said resilient protruded pieces have projections for abutting against said inner surfaces of said connecting terminal sections.

10. The fusible link of claim 6, wherein said resilient protruded pieces are four pieces.

* * * * *